United States Patent [19]

Carpenter

[11] Patent Number: 4,941,297

[45] Date of Patent: Jul. 17, 1990

[54] FLARED VANE FOR ABRASIVE BLASTING WHEEL

[75] Inventor: James H. Carpenter, Hagerstown, Md.

[73] Assignee: Pangborn Corporation, Hagerstown, Md.

[21] Appl. No.: 765,363

[22] Filed: Aug. 13, 1985

[51] Int. Cl.[5] ..... B24C 5/06

[52] U.S. Cl. ..... 51/434; 51/435

[58] Field of Search ..... 51/431, 432, 433, 434, 51/435, 410; 241/275

[56] References Cited

U.S. PATENT DOCUMENTS

| | | | |
|---|---|---|---|
| 2,204,635 | 6/1940 | Turnbull | 51/435 |
| 2,212,451 | 8/1940 | Peik | 51/434 |
| 3,348,339 | 10/1967 | Bowling, Jr. | 51/435 |
| 3,694,963 | 10/1972 | Leliaert | 51/435 |
| 3,872,624 | 3/1975 | Ramaswamy | 51/435 |
| 4,249,350 | 2/1981 | Goff | 51/434 |
| 4,402,163 | 9/1983 | Carpenter et al. | 51/435 |

FOREIGN PATENT DOCUMENTS

| | | | |
|---|---|---|---|
| 0377219 | 6/1964 | Switzerland | 51/410 |

*Primary Examiner*—Robert A. Rose

*Attorney, Agent, or Firm*—Charles E. Brown; Charles A. Brown

[57] ABSTRACT

A vane assembly for an abrasive blasting wheel wherein the vanes are provided with sidewalls flaring away from the heel of the vane at an angle in the range of 2 to 7 degrees to effect oven distribution of abrasive transverse of the vane face at a varying operating rate.

11 Claims, 2 Drawing Sheets

FIG. 1
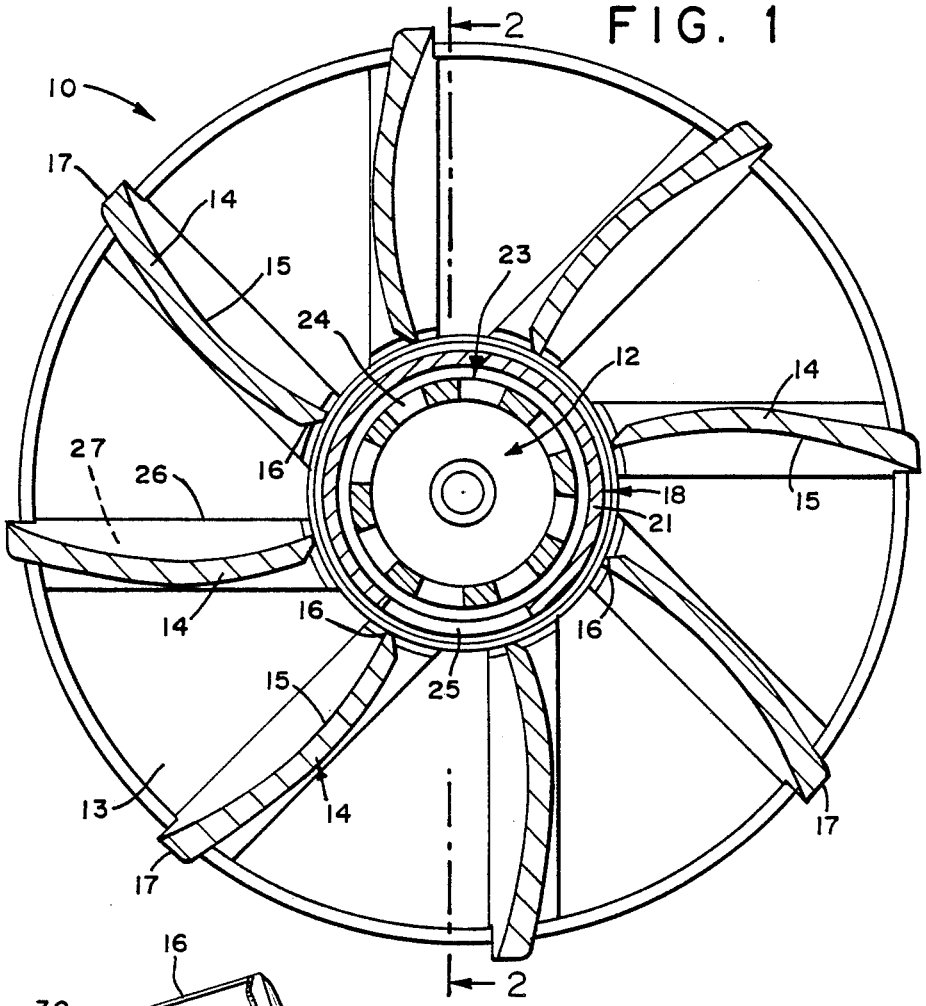
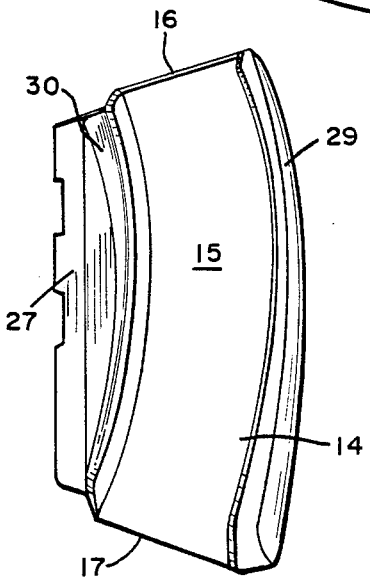
FIG. 3

FLARED VANE FOR ABRASIVE BLASTING WHEEL

CROSS REFERENCE TO RELATED APPLICATION

This is a continuation of application Ser. No. 509,656, filed June 30, 1983.

BACKGROUND OF THE INVENTION

The present invention relates to new and useful improvments in abrasive blasting machines and in particular to the abrasive throwing blades or vanes used in such machines.

Abrasive blasting machines of the type having a wheel or rotor assembly provided with a plurality of abrasive throwing blades or vanes arranged radially about the face of the rotor are well known. In use, a stream of abrasive particulate material is fed into the path of the rotating wheel from an impellar secured to the center of the rotor. The vanes are adapted to receive and throw the abrasive from the periphery of the rotor at an appropriate discharge point in the machine casing at a blasting velocity to strip or clean metal castings or the like.

The throwing vanes due to the nature of their use are subject to excessive wear and therefore removably mounted on a runnerhead portion of the wheel assembly for replacement as needed. In prior art devices the throwing vanes have been provided with varying configurations for improving the abrasive feed by increasing the length or widening the vane for changing the blast pattern as for example disclosed in U.S. Pat. Nos. 3,242,615; 3,348,339 or 3,694,963. In other blasting machines the vanes have been tapered or curved for providing minimum power consumption or for noise reduction purposes such as disclosed in U.S. Pat. Nos. 1,196,885 and 3,872,624. In U.S. Pat. No. 2,330,949 there is disclosed a rotatable abrasive spray head wherein the vanes comprise open face channel members having a flared configuration of 10 or more degrees for spraying the abrasive therefrom.

As is evidenced by these prior art patents a considerable amount of effort has been expended in the past in shaping the longitudinal blast pattern. However, very little attention has been given to the transverse pattern of the abrasive other than an effort to widen the pattern in order to cover a wider surface when blasting lengthwise. It has been found in these prior art vane configurations that uneven distribution of the abrasive occurs transversely across the width of the vane and has led to excessive wear in certain areas on the face of the vane. In most vane configurations the abrasive stream is contained by one sidewall thereof where the abrasive accumulates after it enters the heel area of the vane. The abrasive follows the sidewall in a longitudinal discharge path causing excessive wear in the face of the vane adjacent the sidewall along the flow path as the accumulated abrasive follows the sidewall to its discharge.

It is an object of the present invention to provide a novel blasting wheel for an abrasive blasting machine.

Another object is to provide a throwing vane of novel configuration for effectively reducing wear thereof during use and prolonging the operating life of the vane.

A further object is to provide a vane for a blasting wheel capable of effecting even distribution of abrasive material across the face of the vane during operation of the wheel.

It is still another object to obtain an even distribution of abrasive transversely across the face of a throwing vane surface at high horsepower and high abrasive flow rates without increased costs.

SUMMARY OF THE INVENTION

The present invention contemplates a vane for use in a blasting wheel of an abrasive blasting machine. The vane is provided with spaced longitudinally extending sidewalls which flare away from the heel of the vane at an angle preferably in the range of 2 to 7 degrees. Abrasive material fed to the heel during operation of the blasting wheel spreads transversely of the vane at a controlled rate of flow resulting in even distribution of abrasive along the entire face of the vane.

The above and other objects and advantages of the present invention will appear more fully hereinafter from the detailed description which follows taken together with the accompanying drawings wherein one embodiment of the invention is illustrated.

DESCRIPTION OF THE DRAWINGS

In the Drawings:

FIG. 1 is a cross-sectional front elevational view of a blasting wheel assembly having throwing vanes which incorporate the present invention;

FIG. 3 is a perspective view of a throwing vane of FIGS. 1 and 2 removed from the blasting wheel assembly.

DETAILED DESCRIPTION

Figure 2:
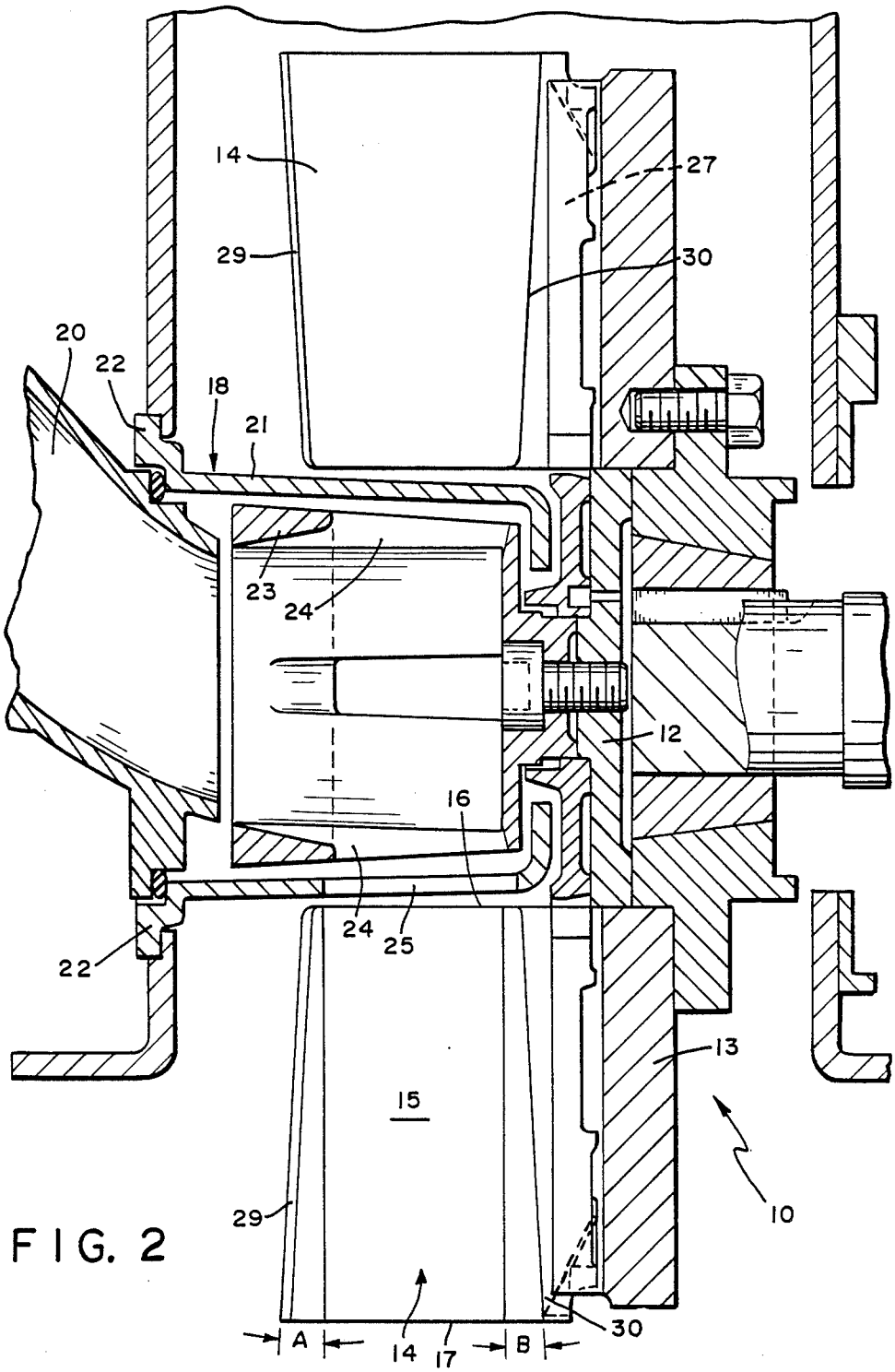
FIG. 2 is a sectional view taken on the line 2—2 of FIG. 1.

As illustrated in the drawings, a throwing wheel assembly of an abrasive blasting machine is generally indicated by the reference numeral 10 in FIGS. 1 and 2. Assembly 10 includes a central hub or rotor 12 to which is affixed a runnerhead 13 having a common axis therewith. A plurality of curved vanes 14 are perpendicularly mounted on the face 15 of runnerhead 13 and extend generally radially from the axis of rotation of rotor 12. An innermost heel portion 16 of each vane 14 is spaced a distance from the axis of rotation for receiving particulate abrasive material from an impeller means 18.

Impeller means 18 is disposed on the hub 12 between the heel ends 16 of vanes 14 for feeding the abrasive particles which are received from a fixed spout 20 to vanes 14 in a usual manner. Impeller means 18 comprises an open ended outer case 21 having flanges 22 connected to the machine casing and open to the spout 20. An impeller 23 is disposed within case 21 and is rotatably affixed to hub 12. Impeller 23 is provided with openings 24 for discharging abrasive received from spout 20 outwardly of case 21 through a discharge opening 25 therein upon rotation of wheel 10. In this manner abrasives are fed to the heels 16 of vanes 14 as vanes 14 rotate past the opening 25. The abrasive is then moved along the face 15 of the vane from the heel 16 to the discharge end 17 for discharge therefrom at a selected blasting velocity.

The face of runnerhead 13 has formed therein a plurality of slots 26 which may be of suitable dovetail or other undercut configuration at an angle to a radial line. Each slot 26 is adapted to receive a base 27 of a curved vane 14 with the base 27 being inserted into the slot 26 and removable therefrom from the periphery of the runnerhead. Once the base is inserted in a slot 26 it is retained therein by a suitable locking pin (not shown).

It is to be understood that the structure thus far described refers to conventional structure as found in known blasting wheel devices and that the present invention which is to be hereinafter described in further detail is not limited to the particular device shown. The drawings have been simplified to show only such conventional parts of wheel assembly 10 as are necessary for a clear understanding of the present invention.

As mentioned it is the feature object of the present invention to provide a vane 14 of novel configuration for increasing the wear characteristics thereof during use by providing even distribution of the abrasive feed. To this end spaced sidewalls 29 and 30 are provided for each vane 14. Sidewalls 29 and 30 are flared away from the center line of face 15 of a vane 14 at an angle in the range of 2 to 7 degrees as designated "A" and "B" respectively in FIG. 2 from heel portion 16 to the discharge end portion 17 of the vane.

In testing of a blasting wheel having vanes 14 made according to the present disclosure excellent wear characteristics were achieved with containment of the abrasive along one sidewall 29 or 30 substantially eliminated. In these tests the abrasive entering a heel 16 of a vane 14 spreads evenly transversely of face 15 resulting in even surface wear and uniform abrasive distribution.

In the mentioned tests, a blasting wheel such as blasting wheel assembly 10 having an 18 inch diameter was used and operated at various RPM in the range of 1300 to 2500 RPM. For example, a test at a speed of 2200 RPM with an abrasive flow velocity from the wheel of 250 FPS showed no improvement or additional spread was effected at a flare angle greater than 2½ degrees. In a test at 1700 RPM and an abrasive flow velocity from the wheel of 190 FPS no spread occurred beyond a flare angle of 7°. At 1300 RPM and 150 FPS no spread occurred beyond 10° or greater. It was further found that no change in abrasive spread characteristics was effected by changning flow rates of the abrasive from the impeller 18 to the vanes 14. It was determined that the spread of abrasive was identical regardless of the latter flow rates provided the flow was within the capacity of the wheel assembly 10. It was concluded that the spread is governed by the flare angle of sidewalls 29 and 30, the RPM of the wheel assembly 10, and the acceleration of the abrasive along the face of the vane.

Although one embodiment of the present invention has been described in detail, it is to be expressely understood that the invention is not limited thereto. Various changes can be made in the design and arrangement of parts without departing from the spirit and scope thereof as the same will now be readily understood by those skilled in the art.

What is claimed is:

1. An abrasive blasting wheel assembly comprising a rotor, a runnerhead concentrically mounted on said rotor for rotation at a predetermined operating RPM, a plurality of spaced radially arranged abrasive particle throwing vanes, means detachably securing said vanes to the face of said runnerhead, impeller means carried by said rotor for feeding particulate abrasive material to said vanes, each of said vanes being provided with an abrasive throwing face having a radially extending centerline, said face being disposed perpendicular to the face of said runnerhead and having spaced side portions flaring away from an abrasive receiving heel end portion of said vane to a discharge end of said vane at a continuous uninterrupted flare angle in the range of 2° to 7° as measured relative to the centerline of said face from said heel end to said discharge end.

2. The wheel assembly of claim 1 wherein said wheel assembly has a diameter of about 18 inches, an operating RPM of said rotor in the range of 1700 RPM to 2500 RPM, and an abrasive flow velocity in the range of 170 to 290 FPS.

3. The wheel assembly of claim 1 wherein the throwing face of said vane is of a curved configuration from the heel portion to the discharge end of the vane at the periphery of said runnerhead.

4. The wheel assembly of claim 3 wherein said side portions of said vane face include spaced side walls flaring away from said heel portion.

5. The whell assembly of claim 1 wherein said impeller comprises a stationary outer casing and an impeller within said outer casing rotatably connected to said rotor, a discharge opening in said outer casing for feeding abrasive material from said rotatable impeller to the heel end portion of said vanes.

6. An abrasive particle throwing vane for use in a rotatable blasting wheel assembly, said vane comprising a heel end portion spaced from a discharge end portion, a particle throwing face intermediate said end portions, said face having a radially extending centerline, said face at any location intermediate said end portions being parallel to said heel end portion, and spaced sides of said face flaring away from said heel end portion to said discharge end of said throwing face at a continuous uninterrupted flare angle in the range of 2° to 7° as measured relative to the centerline of said face from said heel end to said discharge end.

7. The throwing vane of claim 6 wherein said flare angle is no greater than 2½°.

8. The throwing vane of claim 6 wherein the face of said vane is curved from said heel portion to said discharge end.

9. The throwing vane of claim 6 wherein the said spaced sides of said throwing face comprise vertical sidewalls flaring away from the heel portion to the discharge end of said vane at said flare angle.

10. The wheel assembly of claim 1, wherein the flare angle of each of said side portions is the same.

11. The throwing vane of claim 6, wherein the flare angle of each of said spaced sides is the same.

* * * * *